US007703412B2

(12) United States Patent
Iwata

(10) Patent No.: US 7,703,412 B2
(45) Date of Patent: Apr. 27, 2010

(54) LIQUID DISCHARGING APPARATUS, METHOD OF CLEANING HEAD, ELECTRO-OPTICAL DEVICE, METHOD OF MANUFACTURING ELECTRO-OPTICAL DEVICE, AND ELECTRONIC APPARATUS

(75) Inventor: Yuji Iwata, Nagano (JP)

(73) Assignee: Seiko Epson Corporation (JP)

( * ) Notice: Subject to any disclaimer, the term of this patent is extended or adjusted under 35 U.S.C. 154(b) by 1293 days.

(21) Appl. No.: 11/203,604

(22) Filed: Aug. 12, 2005

(65) Prior Publication Data

US 2006/0051514 A1 Mar. 9, 2006

(30) Foreign Application Priority Data

Sep. 8, 2004 (JP) ..... 2004-260565

(51) Int. Cl.
*B05B 15/02* (2006.01)
*B05C 11/00* (2006.01)

(52) U.S. Cl. ..... 118/302; 118/694; 347/22; 347/28; 239/106; 239/115

(58) Field of Classification Search ..... 118/302, 118/313–315, 300, 693, 694, 321, 323; 347/22–33, 347/19; 239/112, 113, 115
See application file for complete search history.

(56) References Cited

U.S. PATENT DOCUMENTS 5,774,485 A 6/1998 Stein
6,342,105 B1 1/2002 Yano et al.
2001/0033309 A1 * 10/2001 Daddey ..... 347/45
2003/0029831 A1 2/2003 Kawase
2003/0071871 A1 * 4/2003 Yun ..... 347/28
2005/0012781 A1 * 1/2005 Miura et al. ..... 347/45
2005/0045096 A1 * 3/2005 Kojima ..... 118/323
2005/0083367 A1 * 4/2005 Nakamura ..... 347/22

FOREIGN PATENT DOCUMENTS

| | | |
|---|---|---|
| CN | 1404625 | 3/2003 |
| JP | 05-042678 | 2/1993 |
| JP | 11-058752 | 3/1999 |
| JP | 11-157087 | 6/1999 |
| JP | 2002-248794 | 9/2002 |
| JP | 2003-270426 | 9/2003 |
| JP | 2004-216642 | 8/2004 |

OTHER PUBLICATIONS

Communication from Korean Patent Office regarding corresponding application.

* cited by examiner

*Primary Examiner*—Yewebdar T Tadesse
(74) *Attorney, Agent, or Firm*—Harness, Dickey & Pierce, P.L.C.

(57) ABSTRACT

A liquid discharging apparatus that discharges liquid droplets onto a work includes a head that is supplied with discharging liquid to discharge the liquid droplets; a liquid cleaning unit that contains cleaning liquid to be mixed with the discharging liquid adhered to a nozzle surface of the head; and a transport unit that moves the nozzle surface of the head relative to the liquid cleaning unit to remove, from the nozzle surface, the discharging liquid adhered to the nozzle surface.

9 Claims, 12 Drawing Sheets

LIQUID DISCHARGING APPARATUS, METHOD OF CLEANING HEAD, ELECTRO-OPTICAL DEVICE, METHOD OF MANUFACTURING ELECTRO-OPTICAL DEVICE, AND ELECTRONIC APPARATUS

RELATED APPLICATIONS

This application claims priority to Japanese Patent Application No. 2004-260565 filed Sep. 8, 2004 which is hereby expressly incorporated by reference herein in its entirety.

BACKGROUND OF THE INVENTION

1. Technical Field

The present invention relates to a liquid discharging apparatus that discharges liquid droplets onto a work, to a method of cleaning a head, to an electro-optical device, to a method of manufacturing an electro-optical device, and to an electronic apparatus.

2. Related Art

Liquid discharging apparatuses may be used as drawing systems that discharge liquid droplets onto a work in an ink-jet method. The drawing system may be used for manufacturing, for example, an electro-optical device, such as a flat panel display.

In general, the liquid discharging apparatus that discharges the liquid droplets in the ink-jet method has a head for discharging the liquid droplets. A nozzle surface of the head needs to be cleaned, if necessary. Therefore, a method of cleaning a head has been suggested (for example, Japanese Unexamined Patent Application Publication No. 2003-270426 (page 10 and FIG. 18)).

In this type of head cleaning apparatus, bubbles, dust, or solidified ink in nozzle openings of the head are ejected to the outside, and then a wiping sheet is pressed against the nozzle surface to clean the nozzle surface.

However, meniscuses (ink interfaces) of ink are positioned at the corresponding nozzle openings in the nozzle surface of the head, and the meniscuses are positioned close to the nozzle surface. Therefore, when the wiping sheet is pressed against the nozzle surface to remove the residual ink from the nozzle surface as in the related art, the meniscuses of ink in the respective nozzle openings are damaged, and thus the ink droplets in the nozzle openings are drawn out from the nozzle surface.

In this case, even though cleaning is performed on the nozzle surface, the ink droplets drawn out from the nozzle openings adhere to the nozzle surface. The ink droplets adhering to the nozzle surface do not necessarily have a bad influence on the discharge of the liquid droplets in the ink-jet method. However, when the ink droplets remaining on the nozzle surface adhere around the nozzle openings, a subsequent ink-discharging operation performed in the ink-jet method causes a flying curve phenomenon of the ink droplets.

Further, when the ink droplets adhere to the nozzle surface for a long time, a nozzle plate constituting the nozzle surface may be corroded away.

SUMMARY

An advantage of the invention is that it provides a liquid discharging apparatus capable of preventing liquid from being drawn out from nozzle openings by a cleaning member when cleaning a nozzle surface of a head using the cleaning member, thereby reliably preventing the nozzle surface from being contaminated by the liquid, a method of cleaning a head, an electro-optical device, a method of manufacturing an electro-optical device, and an electronic apparatus.

According to a first aspect of the invention, a liquid discharging apparatus that discharges liquid droplets onto a work includes a head that is supplied with discharging liquid to discharge the liquid droplets; a liquid cleaning unit that contains cleaning liquid to be mixed with the discharging liquid adhered to a nozzle surface of the head; and a transport unit that moves the nozzle surface of the head relative to the liquid cleaning unit to remove, from the nozzle surface, the discharging liquid adhered to the nozzle surface.

According the first aspect of the invention, the head is supplied with the discharging liquid to discharge the liquid droplets. The liquid cleaning unit contains the cleaning liquid to be mixed with the discharging liquid adhered to the nozzle surface of the head.

The transport unit moves the nozzle surface of the head relative to the liquid cleaning unit to remove the discharging liquid from the nozzle surface.

In this way, the cleaning liquid of the liquid cleaning unit is mixed with the discharging liquid by the relative movement between the nozzle surface of the head and the liquid cleaning unit, so that the discharging liquid can be removed from the nozzle surface. Therefore, the meniscuses of the discharging liquid in the nozzle openings are not damaged unlike the related art, and the nozzle surface is not contaminated by the discharging liquid. Thus, it is possible to prevent the occurrence of a flying curve of the liquid droplets when the liquid droplets are discharged. In addition, since the liquid droplets do not adhere to the nozzle surface, it is possible to reliably prevent the corrosion of the nozzle surface.

Further, in the above-mentioned structure, it is preferable that the liquid cleaning unit include a storage portion that stores the cleaning liquid; and a supply portion that mixes the cleaning liquid of the storage portion with the discharging liquid adhered to the nozzle surface, and that the supply portion be moved substantially parallel to the nozzle surface by the transport unit.

According to the above-mentioned structure, the storage portion of the liquid cleaning unit stores cleaning liquid. The supply portion causes the cleaning liquid in the storage portion to be mixed with the discharging liquid adhered to the nozzle surface. The supply portion is moved substantially parallel to the nozzle surface by the transport unit.

Therefore, since the supply portion is moved substantially parallel to the nozzle surface, it is possible to reliably mix the cleaning liquid from the supply portion with the discharging liquid adhered to the nozzle surface.

Furthermore, in the above-mentioned structure, it is preferable that a lyophobic treatment be performed on the nozzle surface to repel the discharging liquid.

According to this structure, the lyophobic treatment is performed on the nozzle surface to repel the discharging liquid.

Therefore, since the lyophobic treatment is performed on the nozzle surface, it is possible to mix the cleaning liquid with the discharging liquid, and thus to easily remove, from the nozzle surface, the discharging liquid adhered to the nozzle surface.

In the above-mentioned structure, it is preferable that the discharging liquid be a solution containing a functional material, and that the cleaning liquid be a solvent used for the solution.

According to this structure, the discharging liquid is a liquid containing a functional material, and the cleaning liquid is a solvent used for the liquid.

Therefore, since the solvent used for the liquid is used, the discharging liquid of the head and the nozzle surface are not contaminated by the cleaning liquid.

Further, in the above-mentioned structure, it is preferable that the same liquid as the discharging liquid to be supplied to the head be used as the cleaning liquid.

According to this structure, since the same liquid as the discharging liquid to be supplied to the head is used as the cleaning liquid, it is possible to prevent the contamination of the nozzle surface and the discharging liquid of the head.

Furthermore, in the above-mentioned structure, it is preferable that the storage portion storing the cleaning liquid include a liquid level changing portion that changes the liquid level of the cleaning liquid.

According to this structure, the storage portion storing the cleaning liquid has the liquid level changing portion. The liquid level changing portion can change the liquid level of the cleaning liquid.

Therefore, the supply portion can reliably supply the cleaning liquid to the discharging liquid on the nozzle surface by changing the liquid level of the cleaning liquid according to the residual amount of the cleaning liquid in the storage portion.

Moreover, in the above-mentioned structure, it is preferable that the supply portion supplying the cleaning liquid include a discharge height changing portion that changes the discharge height of the cleaning liquid.

According to this structure, the discharge height changing portion can change the discharge height of the cleaning liquid.

In this way, the cleaning liquid can be reliably mixed with the discharging liquid adhered to the nozzle surface by adjusting the discharge height.

According to a second aspect of the invention, there is provided a method of cleaning a head of a liquid discharging apparatus that discharges liquid droplets onto a work. The cleaning method includes mixing cleaning liquid with discharging liquid adhered to a nozzle surface of the head, using a liquid cleaning unit, the head being supplied with the discharging liquid to discharge the liquid droplets; and moving the nozzle surface of the head relative to the liquid cleaning unit, using a transport unit, to remove the discharging liquid from the nozzle surface.

In this way, the cleaning liquid of the liquid cleaning unit can be mixed with the discharging liquid by moving the nozzle surface of the head relative to the liquid cleaning unit, so that the discharging liquid can be removed from the nozzle surface. Therefore, the meniscuses of the discharging liquid in the nozzle openings are not damaged unlike the related art, and the nozzle surface is not contaminated by the discharging liquid. Thus, it is possible to prevent the occurrence of a flying curve of the liquid droplets when the liquid droplets are discharged. In addition, since the liquid droplets do not adhere to the nozzle surface, it is possible to reliably prevent the corrosion of the nozzle surface.

According to a third aspect of the invention, there is provided a method of manufacturing an electro-optical device using a liquid discharging apparatus that discharges liquid droplets from a head onto a work. The manufacturing method includes mixing cleaning liquid with discharging liquid adhered to a nozzle surface of the head, using a liquid cleaning unit, the head being supplied with the discharging liquid to discharge the liquid droplets; moving the nozzle surface of the head relative to the liquid cleaning unit, using a transport unit, to remove the discharging liquid from the nozzle surface, thereby cleaning the nozzle surface; and discharging the liquid droplets onto the work after cleaning the nozzle surface.

In this way, the cleaning liquid of the liquid cleaning unit can be mixed with the discharging liquid by moving the nozzle surface of the head relative to the liquid cleaning unit, so that the discharging liquid can be removed from the nozzle surface. Therefore, the meniscuses of the discharging liquid in the nozzle openings are not damaged unlike the related art, and the nozzle surface is not contaminated by the discharging liquid. Thus, it is possible to prevent the occurrence of a flying curve of the liquid droplets when the liquid droplets are discharged. In addition, since the liquid droplets do not adhere to the nozzle surface, it is possible to reliably prevent the corrosion of the nozzle surface.

According to a fourth aspect of the invention, there is provided an electro-optical device that is manufactured by a method using a liquid discharging apparatus that discharges liquid droplets from a head onto a work. The method includes mixing cleaning liquid with discharging liquid adhered to a nozzle surface of the head, using a liquid cleaning unit, the head being supplied with the discharging liquid to discharge the liquid droplets; moving the nozzle surface of the head relative to the liquid cleaning unit, using a transport unit, to remove the discharging liquid from the nozzle surface, thereby cleaning the nozzle surface; and discharging the liquid droplets onto the work after cleaning the nozzle surface.

In this way, the cleaning liquid of the liquid cleaning unit can be mixed with the discharging liquid by moving the nozzle surface of the head relative to the liquid cleaning unit, so that the discharging liquid can be removed from the nozzle surface. Therefore, the meniscuses of the discharging liquid in the nozzle openings are not damaged unlike the related art, and the nozzle surface is not contaminated by the discharging liquid. Thus, it is possible to prevent the occurrence of a flying curve of the liquid droplets when the liquid droplets are discharged. In addition, since the liquid droplets do not adhere to the nozzle surface, it is possible to reliably prevent the corrosion of the nozzle surface.

According to a fifth aspect of the invention, an electronic apparatus includes the above-mentioned electro-optical device.

BRIEF DESCRIPTION OF THE DRAWINGS

The invention will be described with reference to the accompanying drawings, wherein like numbers reference like elements, and wherein.

DESCRIPTION OF THE EMBODIMENTS

Hereinafter, preferred embodiments of the invention will be described with reference to the accompanying drawings.

Figure 1:
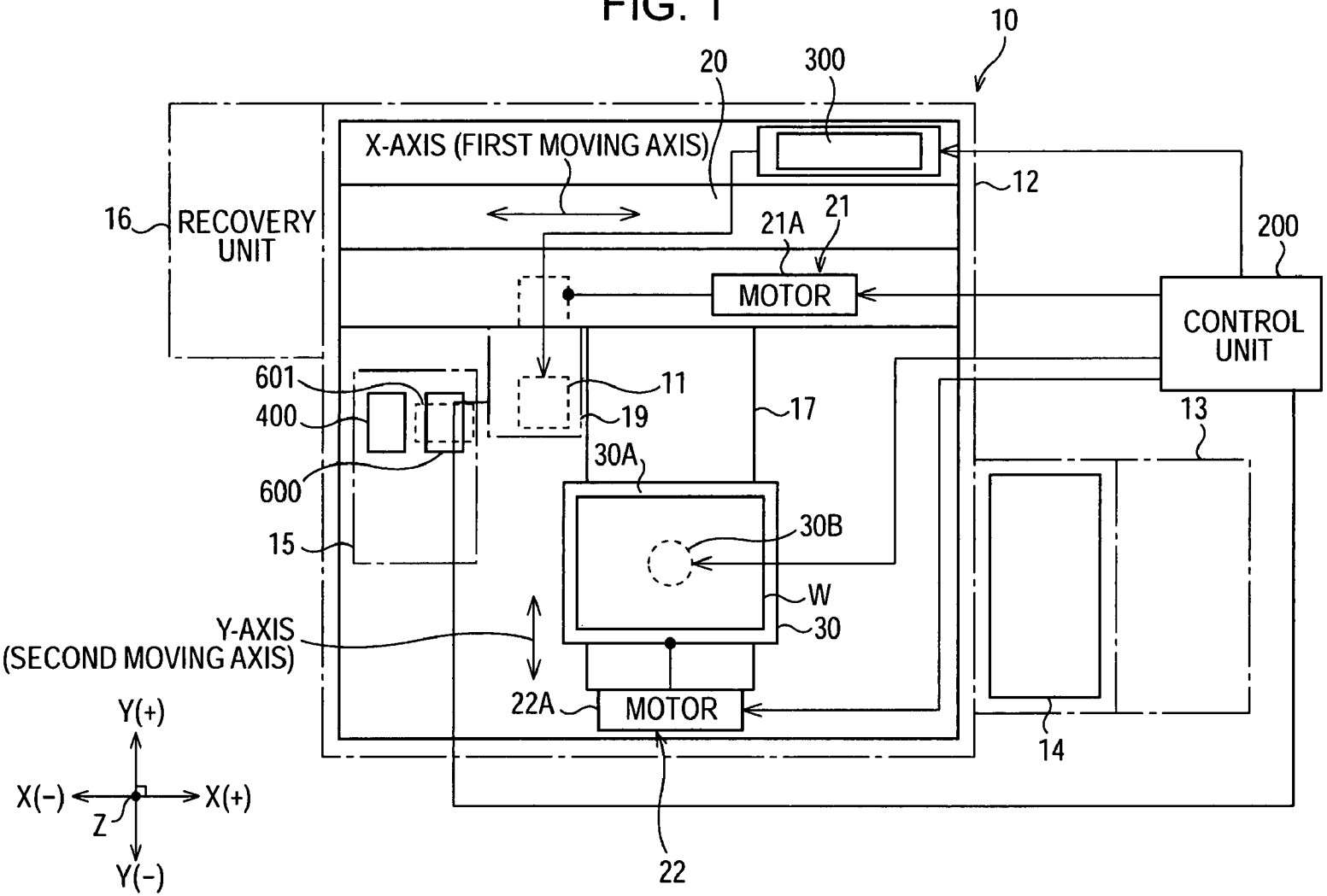
FIG. 1 is a plan view of a preferred embodiment of a liquid discharging apparatus according to the invention.

FIG. 1 is a plan view illustrating a preferred embodiment of a liquid discharging apparatus of the invention.

A liquid discharging apparatus 10 shown in FIG. 1 can be used as a drawing system. The drawing system is incorporated into a manufacturing line of, for example, an organic EL (electroluminescent) device, which is a kind of flat panel display. The liquid discharging apparatus, 10 can form light-emitting elements serving as pixels of, for example, an organic EL device.

The liquid discharging apparatus 10 can be used as, for example, an ink-jet drawing system. The liquid discharging apparatus 10 forms light-emitting elements of an organic EL device using a liquid discharging method (ink-jet method). A head (referred to as a functional liquid discharging head) of the liquid discharging apparatus 10 can form the light-emitting element of the organic EL device. Specifically, in a process of manufacturing the organic EL device, the head containing a light-emitting material relatively scans a substrate (an example of a work) having bank portions thereon, so that the liquid discharging apparatus 10 can form a hole injecting/transporting layer and a light-emitting layer to correspond to positions where pixel electrodes are formed on the substrate, through a bank forming process and a plasma process.

For example, when two liquid discharging apparatuses 10 are prepared, one liquid discharging apparatus 10 can form the hole injecting/transporting layer, and the other liquid discharging apparatus 10 can form R (red), G (green), and B (blue) light-emitting layers.

The liquid discharging apparatus 10 shown in FIG. 1 is provided in a chamber 12. The chamber 12 includes a chamber 13. A work carrying table 14 is provided in the chamber 13. The work carrying table 14 is a table for carrying a work W into the chamber 12 or for carrying out the processed work W from a table 30 in the chamber 12.

A maintenance unit 15 for performing the maintenance of the head 11 is provided in the chamber 12 shown in FIG. 1. A recovery unit 16 is provided outside the chamber 12.

The maintenance unit 15 includes an absorption unit 400, a liquid cleaning unit 600, a flushing unit (not shown), a discharge test unit (not shown), and a weighting unit (not shown).

The flushing unit receives liquid droplets preliminarily discharged from the head 11. The absorption unit 400 absorbs liquid droplets or bubbles from nozzles formed in a nozzle surface of the head 11.

The discharge test unit tests the discharge state of the liquid droplets discharged from the head 11. The weighting unit measures the weight of the liquid droplets discharged from the head 11.

The recovery unit 16 includes, for example, a liquid recovery system for recovering the discharged liquid droplets and a cleaning liquid supply system for supplying a cleaning solvent to be used after wiping.

The liquid cleaning unit 600 shown in FIG. 1 is arranged in the maintenance unit 15. The liquid cleaning unit 600 contains cleaning liquid to be mixed with the liquid adhered to the nozzle surface of the head 11, which will be described later. A transport unit 601 moves the liquid cleaning unit 600 substantially parallel to the nozzle surface of the head 11 to cause the liquid adhered to the nozzle surface to be removed from the nozzle surface.

The chamber 12 and the chamber 13 are independently managed so that a variation in atmosphere does not occur in the chambers 12 and 13. The reason why the chambers 12 and 13 are used is to remove the effects of air on an organic EL device since water in the air has a negative effect on the organic EL device when the organic EL device is manufactured. Dry air is continuously injected and exhausted into and from the chambers 12 and 13 to cause the chambers 12 and 13 to be maintained in a dry atmosphere.

Next, components in the chamber 12 shown in FIG. 1 will be described below.

The chamber 12 includes a frame 20, the head 11, a carriage 19, a liquid storage portion 300, a first operating unit 21, a second operating unit 22, the table 30, and a guide base 17 therein.

The frame 20 shown in FIG. 1 is horizontally provided along an X-axis direction. The guide base 17 is provided along a Y-axis direction. The frame 20 is provided above the guide base 17. The X-axis corresponds to a first moving axis, and the Y-axis corresponds to a second moving axis. The X-axis and the Y-axis are perpendicular to each other, and are also perpendicular to a Z-axis. The Z-axis corresponds to a direction orthogonal to the plane of FIG. 1.

The first operating unit 21 linearly reciprocates the carriage 19 and the head 11 along the frame 20 in the X-axis direction.

The second operating unit 22 includes the table 30. The table 30 can detachably load the work W shown in FIG. 1. The table 30 of the second operating unit 22 holds the work W when liquid droplets are discharged from the head 11 onto the work W. In addition, the second operating unit 22 can linearly move the work W along the Y-axis direction on the guide base 17.

The first operating unit 21 includes a motor 21A for linearly moving the carriage 19 and the head 11 in the X-axis direction. The motor 21A can linearly move the carriage 19 and the head 11 in the X-axis direction using, for example, a feed screw. The motor 21A may be a rotary electromotive motor or a linear motor.

A motor 22A of the second operating unit 22 can linearly move the table 30 along the guide base 17 in the Y-axis direction. A rotary electromotive motor for rotating, for example, a feed screw can be used as the motor 22A. Alternatively, a linear motor can be used as the motor 22A, instead of the rotary electromotive motor.

The table 30 of the second operating unit 22 has a mounting surface 30A. The mounting surface 30A is perpendicular to the Z-axis direction of FIG. 1. The mounting surface 30A has an absorbing portion 30B. The absorbing portion 30B can absorb the work W by vacuum absorption. In this way, the work W can be rigidly fixed to the mounting surface 30A in a detachable manner, without deviating therefrom.

Next, the structure of the carriage 19 and the head 11 will be described with reference to FIGS. 2 and 3.

Figure 2:
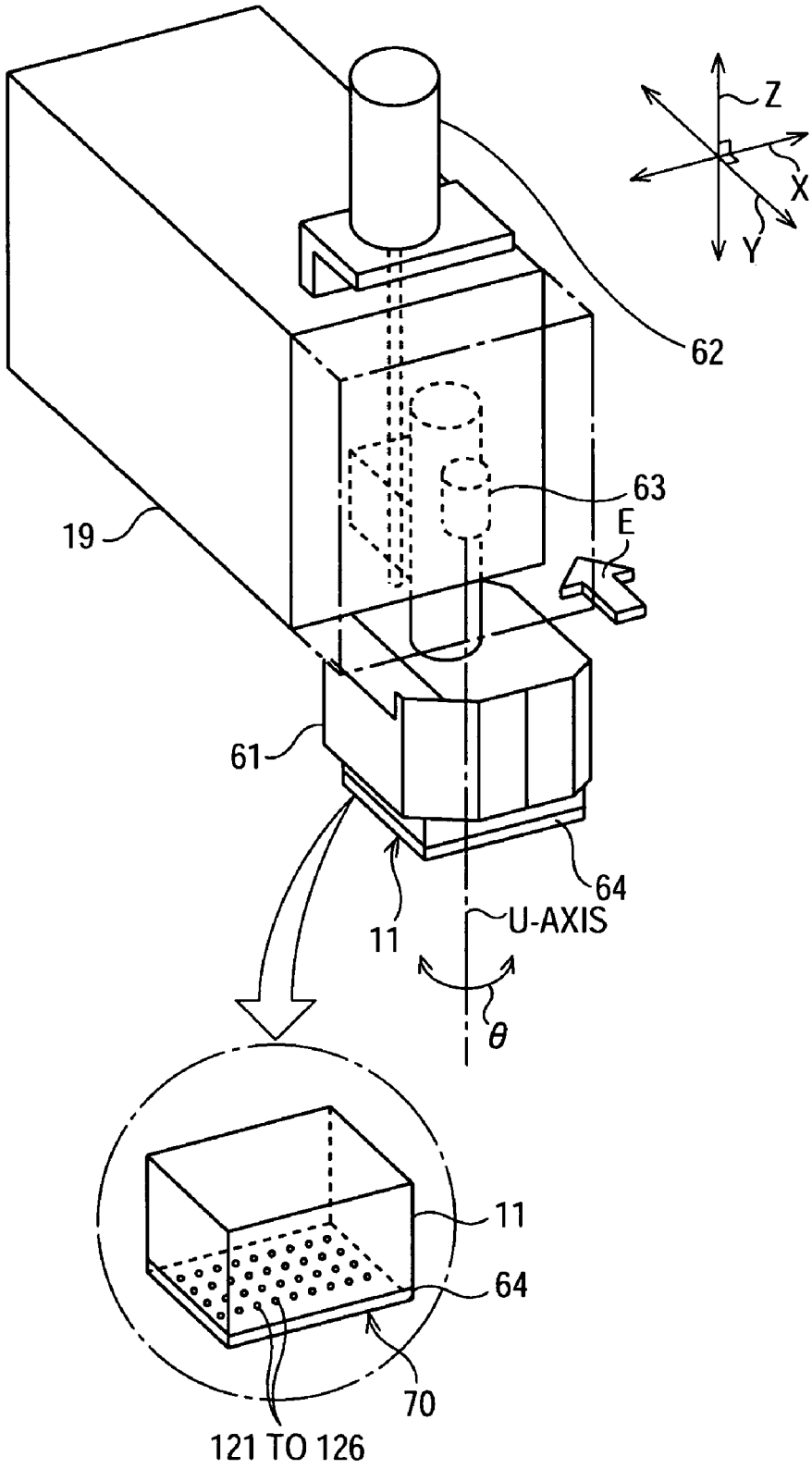
FIG. 2 is a perspective view illustrating a carriage, a head, etc., of the liquid discharging apparatus shown in FIG. 1.
Figure 3:
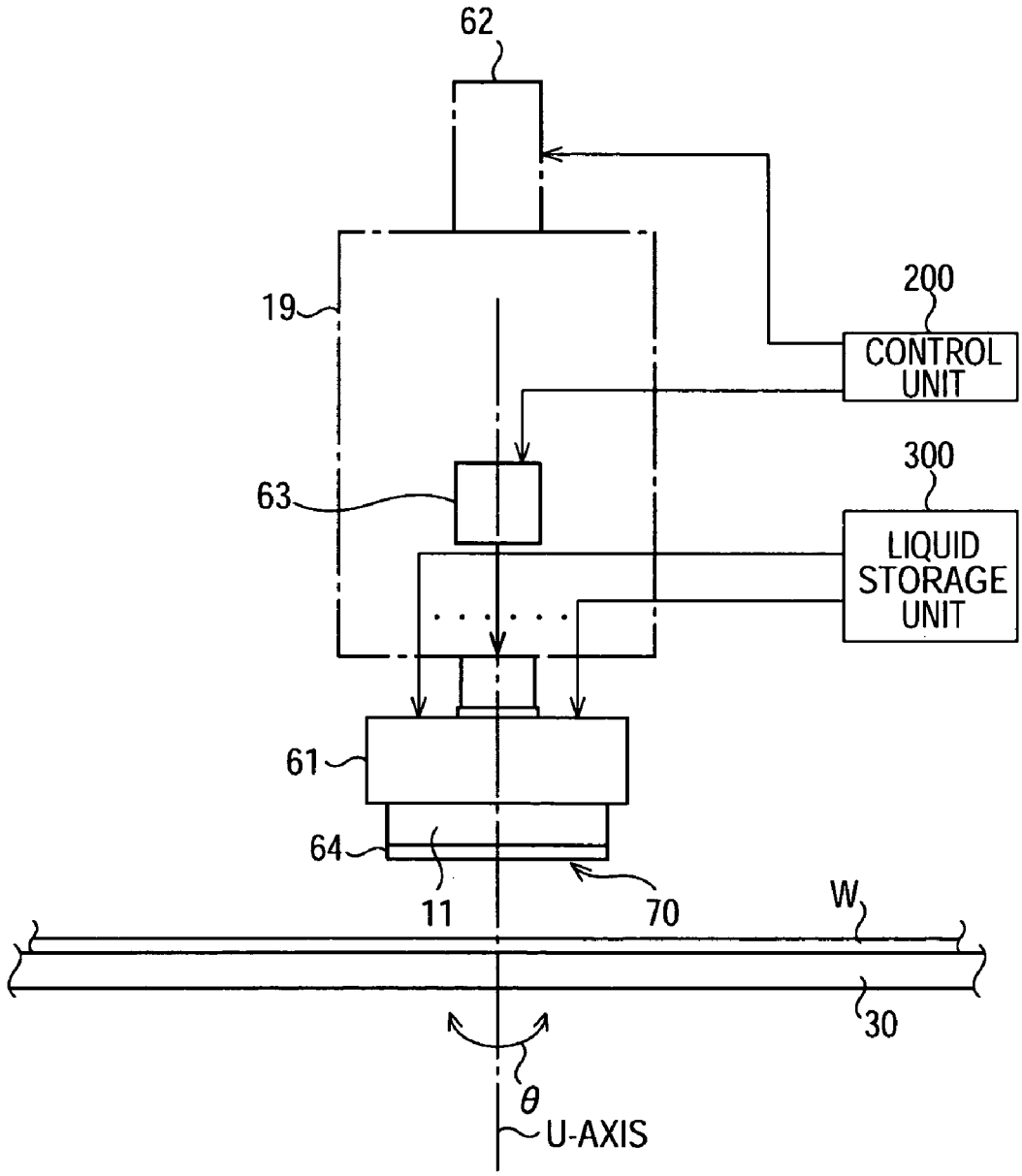
FIG. 3 is a front view of the carriage, the head, etc., shown in FIG. 2, as viewed from arrow E of FIG. 2.

FIG. 2 is a perspective view illustrating the appearance of the carriage 19 and the head 11, and FIG. 3 is a front view thereof, as viewed from the direction of arrow E shown in FIG. 2.

The carriage 19 can be moved in the X-axis direction by the motor 21A shown in FIG. 1. The carriage 19 detachably supports the head 11 using a head holder 61.

As shown in FIG. 3, when a motor 62 is operated by commands from a control unit 200, the head holder 61 and the head 11 can be vertically moved in the Z-axis direction. In addition, when a motor 63 is operated by commands from the control unit 200, the head 11 can be rotated on a U-axis in the θ direction.

As shown in FIGS. 2 and 3, the head 11 has a nozzle plate 64. A lower surface of the nozzle plate 64 is a nozzle surface 70. The nozzle surface 70 has a plurality of nozzle openings 121 to 126 therein. The head 11 is connected to the liquid storage unit 300. The liquid storage unit 300 contains liquid to be discharged onto the work W, so that it is called a functional liquid storage unit. The discharging liquid contained in the liquid storage unit 300 can be discharged through the nozzle openings 121 to 126 in an ink-jet method by the operation of, for example, piezoelectric vibrators 789 shown in FIG. 4A.

Figure 4A:
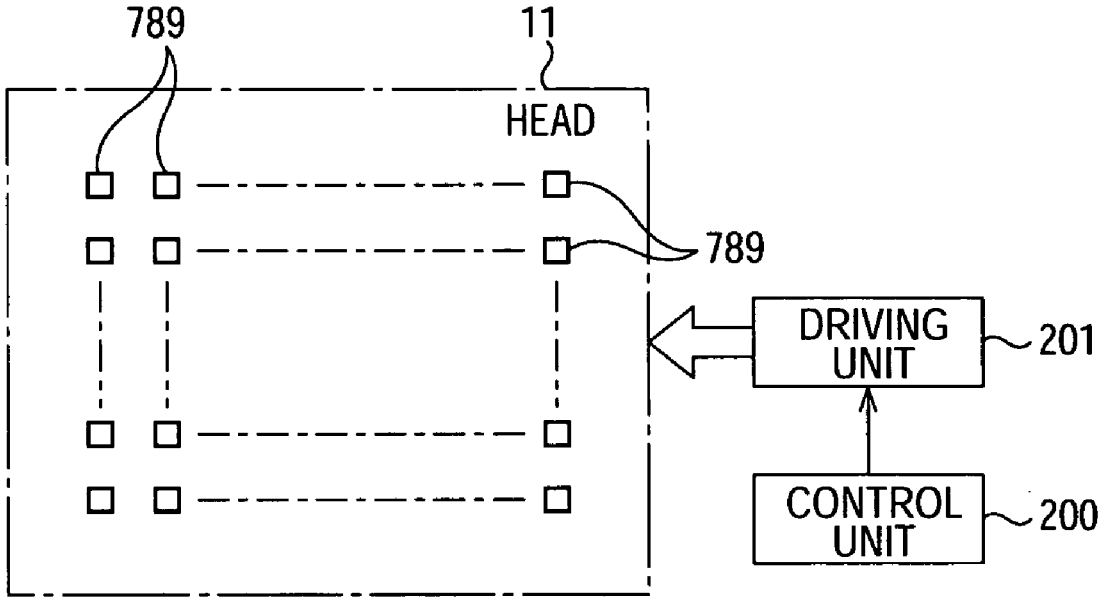
FIG. 4A is a view illustrating piezoelectric vibrators of the head.

FIG. 4A shows a plurality of piezoelectric vibrators 789 arranged in the head 11. The piezoelectric vibrators 789 are arranged corresponding to the nozzles of the head 11 shown in FIG. 2, respectively. The control unit 200 shown in FIG. 4A transmits signals to a driving unit 201 to drive some of the plurality of piezoelectric vibrators 789, so that liquid droplets can be discharged in the ink-jet method through the nozzle openings 121 to 126 of the nozzles, shown in FIG. 2, corresponding to the driven piezoelectric vibrators 789.

Next, the liquid storage unit 300 will be described with reference to FIGS. 4B, 5, and 6.

Figure 4B:
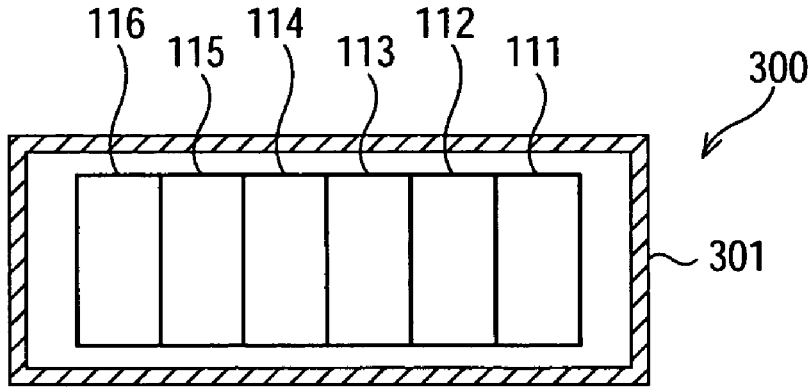
FIG. 4B is a view illustrating the structure of a liquid storage unit of the head.

As shown in FIG. 4B, the liquid storage unit 300 includes, for example, a plurality of liquid packs 111 to 116 and a container 301 for containing these liquid packs. Although six liquid packs 111 to 116 are used in this embodiment, the number of liquid packs is not limited thereto. For example, two to five liquid packs or seven or more liquid packs may be used.

The respective liquid packs 111 to 116 are made of a flexible material, and contains the same type or different types of discharging liquid. Compressed air is injected from the outside into the container 301 to press the liquid packs 111 to 116, so that liquid can be independently discharged from the respective liquid packs 111 to 116.

Figure 5:
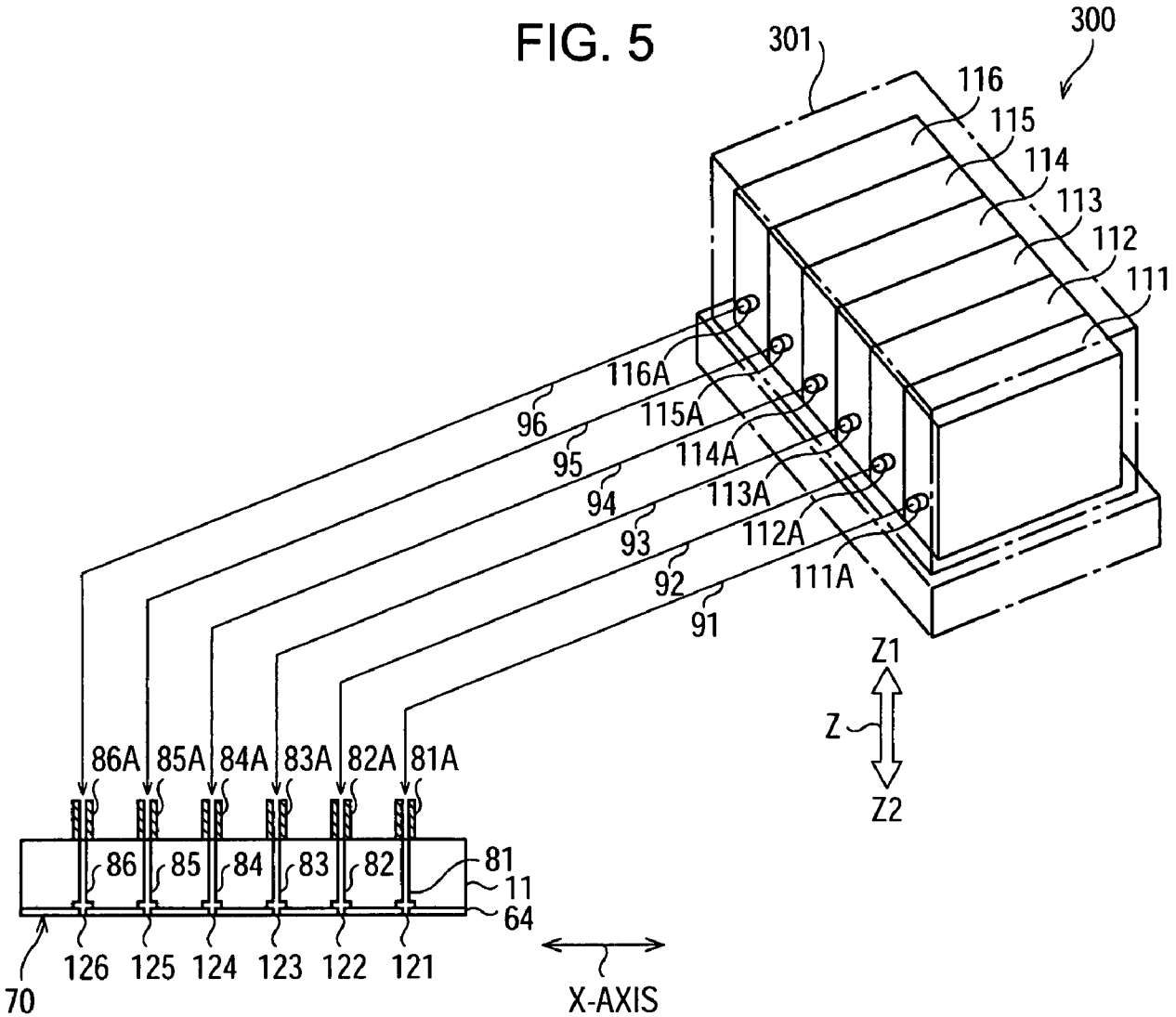
FIG. 5 is a view illustrating the connection between the liquid storage unit and the head.

The liquid packs 111 to 116 shown in FIG. 5 correspond to nozzles 81 to 82 of the head 11, and are detachably connected thereto through liquid supply tubes 91 to 96, respectively. One end of the liquid supply tube 91 is detachably connected to a connecting portion 111A of the liquid pack 111. The other end of the liquid supply tube 91 is detachably connected to a connecting portion 81A of the head 11.

Similarly, one end of each of the liquid supply tubes 92 to 96 is detachably connected to each of connecting portions 112A to 116A of the liquid packs 112 to 116. The other ends of the liquid supply tubes 92 to 96 are detachably connected to connecting portions 82A to 86A of the head 11, respectively.

As shown in FIG. 5, the head 11 includes the plurality of nozzles 81 to 86. The nozzles 81 to 86 include the nozzle openings 121 to 126, respectively. For example, several tens or several thousands of nozzles 81 are arranged in the vertical direction of the plane of FIG. 5, thereby forming a row of nozzles. Similarly, the other nozzles 82 to 86 are also arranged in the vertical direction of the plane of FIG. 5, thereby forming rows of nozzles, respectively. The nozzle openings 121 to 126 are formed in the nozzle surface 70 of the nozzle plate 64.

The nozzle surface 70 faces in a Z2 direction of the Z-axis, which is a downward direction in FIG. 5. As such, for example, six rows of nozzles (six rows of nozzle openings) are arranged in the nozzle surface 70 in the vertical direction of the plane of FIG. 5.

Figure 6:
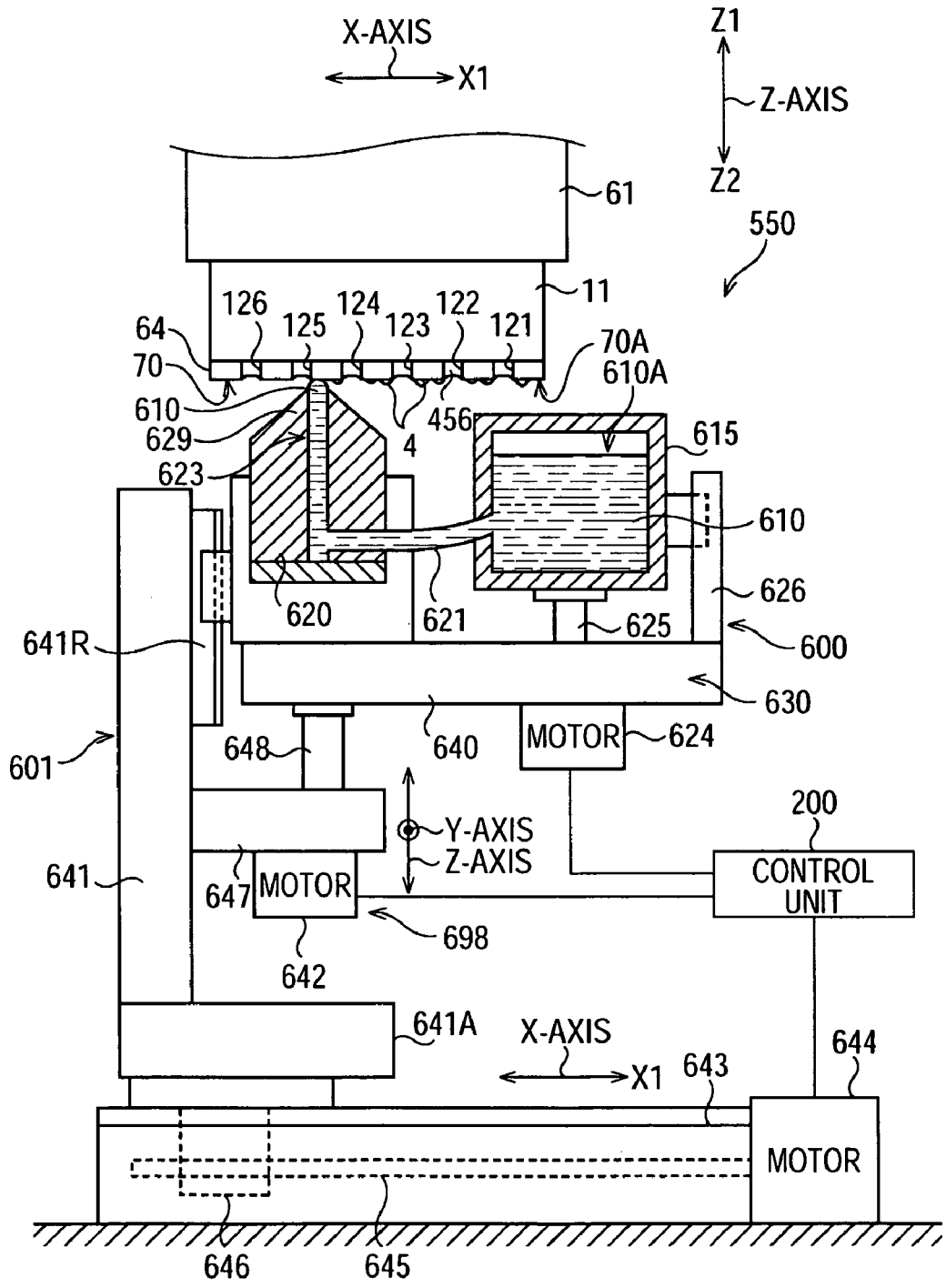
FIG. 6 is a view illustrating the structure of a liquid cleaning unit and a transport unit.

FIG. 6 shows the structure of the head 11, the liquid cleaning unit 600, and the transport unit 601.

In FIG. 6, the nozzle plate 64 is bonded to the lower surface of the head 11 by, for example, an adhesive. The nozzle plate 64 has the nozzle openings 121 to 126 therein. The lower surface of the nozzle plate 64 is the nozzle surface 70. A lyophobic treatment (which is called a water-repellent treatment) 70A is performed on the nozzle surface 70. The lyophobic treatment 70A is performed by coating, for example, a fluoric resin (tetrafluoroethylene resin). The nozzle surface 70 is arranged to face in the Z2 direction of the Z-axis, that is, in the downward direction in FIG. 6.

Next, the liquid cleaning unit 600 shown in FIG. 6 contains cleaning liquid 610 to be mixed with discharging liquid 4 adhering to the nozzle surface 70 of the head 11, so that the cleaning liquid 610 is mixed with the discharging liquid 4. The transport unit 601 relatively moves the liquid cleaning unit 600 mainly in the X1 direction to remove, from the nozzle surface 70, the discharging liquid 4 adhering to the nozzle surface 70, without coming into contact with the nozzle surface 70.

First, the structure of the liquid cleaning unit 600 will be described. The liquid cleaning unit 600 includes a storage portion 615 and a supply portion 620.

The cleaning liquid 610 is contained in the storage portion 615. The storage portion 615 has a supply tube (not shown) so as to be replenished with the cleaning liquid 610. Alternatively, the storage portion 615 may be replaced to supplement the cleaning liquid 610.

The storage portion 615 and the supply portion 620 are connected to each other through a tube 621. One end of the tube 620 is connected to the inside of the storage portion 615, and the other end of the tube 621 is connected to a lower part of a slit 623 of the supply portion 620. The slit 623 is arranged in the Z-axis direction, and is called a nozzle. An upper end of the slit 623 is positioned to face the nozzle surface 70 without coming into contact with the nozzle surface 70. That is, the upper end of the slit 623 protrudes in the Z1 direction.

The storage portion 615 includes a liquid level changing portion 630. The liquid level changing portion 630 can move the storage portion 615 in the Z-axis direction. The liquid level changing portion 630 includes a motor 624, an operating shaft 625, and a guide member 626. When the motor 624 is operated, the operating shaft 625 moves in the Z-axis direction, so that the storage portion 615 moves along the guide member 626 in the Z-axis direction.

The reason why the liquid level changing portion 630 is provided is to cope with a variation in a liquid level 610A in the Z-axis direction caused by a change of the residual amount of the cleaning liquid 610 in the storage portion 615. When the liquid level 610A of the cleaning liquid 610 is lowered, the storage portion 615 is left up in the Z2 direction, so that the cleaning liquid 610 in the storage portion 615 can be stably supplied to the supply portion 620 through the tube 621.

The liquid level changing portion 630 and the supply portion 620 are supported by a supporting member 640.

Next, the transport unit 601 will be described.

The transport unit 601 arranges the slit 623 of the liquid cleaning member 600 at a proper position with respect to the nozzle surface 70, and moves both ends of the slit 623 of the supply portion 620 relative to the nozzle surface 70 in the non-contact direction, as described above.

In this way, the cleaning liquid 610 discharged from the slit 623 in the Z2 direction is mixed with the discharging liquid 4 adhering to the nozzle surface 70, so that the discharging liquid 4 on the nozzle surface 70 can be removed from the nozzle surface 70.

The transport unit 601 includes the supporting member 640, a guide member 641, a motor 642, a stage 643, and a motor 644. The guide member 641 is provided parallel to the Z-axis direction. A base member 641A of the guide member 641 can be moved in the X-axis direction with respect to the stage 643. For example, the base member 641A has a nut 646. The nut 646 meshes with a feed bolt 645. The feed screw 645 is rotated by the operation of the motor 644. In this structure, when the motor 644 is operated, the guide member 641 and the liquid cleaning unit 600 can be moved in the X-axis direction.

The motor 642 is mounted to a supporting member 647 attached to the guide member 641. When the motor 642 is operated, an operating shaft 648 is moved in the Z-axis direction. The supporting member 640 can be guided in the Z-axis direction along a guide body 641R of the guide member 641. When the motor 642 is operated to move the operating shaft 648 in the Z-axis direction, the liquid cleaning unit 600 supported by the supporting ember 640 can move in the Z-axis direction. The motor 642, the operating shaft 648, and the guide body 641R constitute a discharge-height changing portion 698 for the cleaning liquid. Therefore, it is possible to change the discharge height of the cleaning liquid, corresponding to the height of the nozzle surface 70 in the Z-axis direction, by changing the position of an upper end 629 of the supply portion 620 in the Z-axis direction.

Next, a method of cleaning the head of the liquid discharging apparatus will be described with reference to FIGS. 6 and 7.

Liquid droplets are respectively discharged from the nozzle openings 121 to 126 in the nozzle surface 70 shown in FIG. 6. Then, a drawing operation is performed on the surface of the work W shown in FIG. 1 by the discharged liquid droplets.

Figure 7:
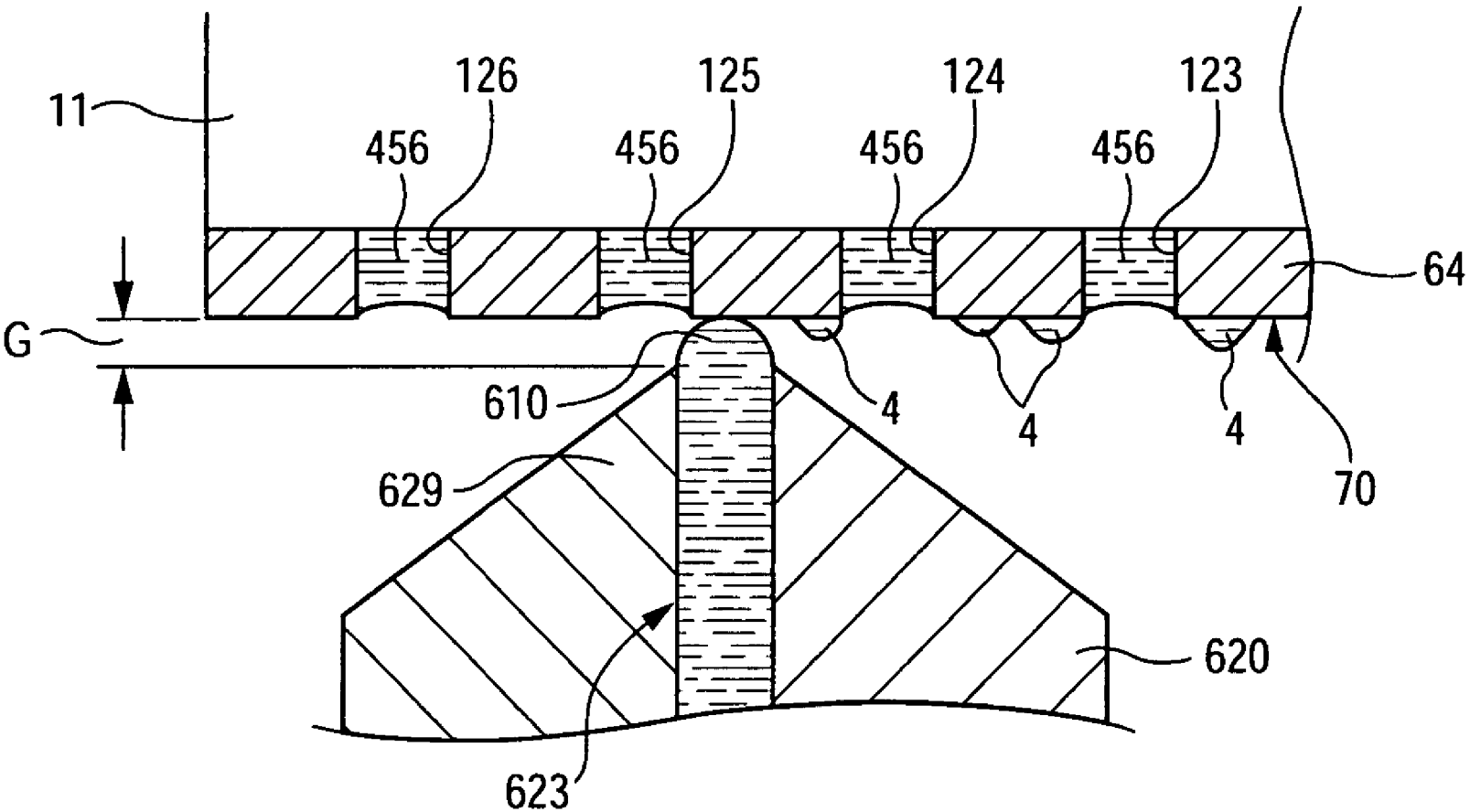
FIG. 7 is a view illustrating a nozzle surface and cleaning liquid at a leading end of a slit.

During the drawing operation or after the drawing operation is completed, the discharging liquid 4, which is ink, adheres to the nozzle surface 70, as shown in FIGS. 6 and 7. When the discharging liquid 4 adheres to the nozzle surface 70, a flying curve phenomenon of the ink droplets or a discharge defect occurs in an ink droplet discharging operation performed subsequent to the drawing operation. When the discharging liquid (ink) 4 adheres to the nozzle surface 70 for a long time, the nozzle plate constituting the nozzle surface may corrode away.

Therefore, in order to prevent the discharging liquid (ink) 4 from adhering to the nozzle surface 70, the discharging liquid 4 adhering to the nozzle surface 70 is removed by the liquid cleaning unit 600 shown in FIG. 6.

As shown in FIGS. 6 and 7, ink droplets (an example of the discharging droplet) 456 placed in the nozzle openings 121 to 126 form meniscuses whose upper parts have concave shapes.

Figure 8A:
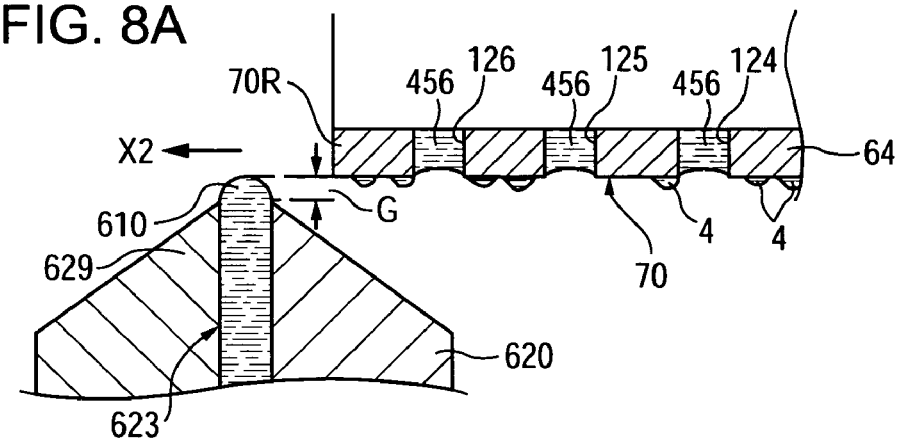
FIGS. 8A to 8C are views illustrating an example in which the cleaning liquid at the leading end of the slit is mixed with liquid adhered to nozzles in the nozzle surface, so that the liquid is removed from the nozzle surface.

The liquid cleaning unit 600 shown in FIG. 6 is left up in the Z1 direction together with the supporting member 640, so that the upper end of the slit 623 is in a non-contact state where it is separated from the nozzle surface 70. As shown in FIG. 8A, a predetermined gap G is formed between the nozzle surface 70 and the upper end 629. In this state, the supply portion 620 shown in FIG. 6 is separated from an end portion 70R of the nozzle surface 70 in the X2 direction. In this way, the supply portion 620 is left up to nearly a height where the cleaning liquid 610 at the upper end of the slit 623 comes into contact with the nozzle surface 70.

Figure 8B:
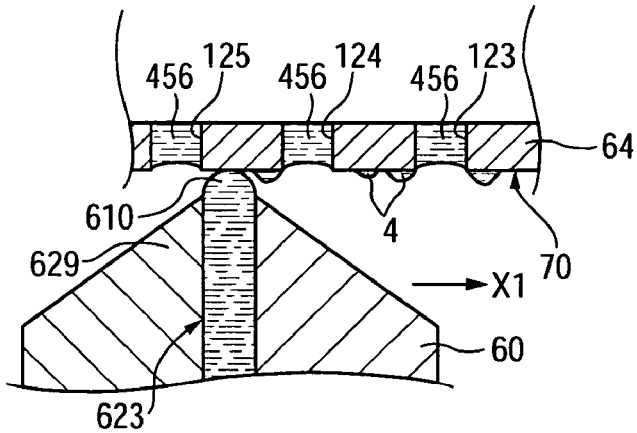

Then, as shown in FIG. 8B, the motor 644 shown in FIG. 6 is operated to move the guide member 641 and the liquid cleaning unit 600 in the X1 direction so as to be parallel to the nozzle surface 70. In this way, the cleaning liquid 610 discharged from the upper end 629 of the slit 623 is mixed with the discharging liquid 4 adhering to the nozzle surface 70, and thus the discharging liquid 4 can be easily removed from the nozzle surface 70.

Figure 8C:
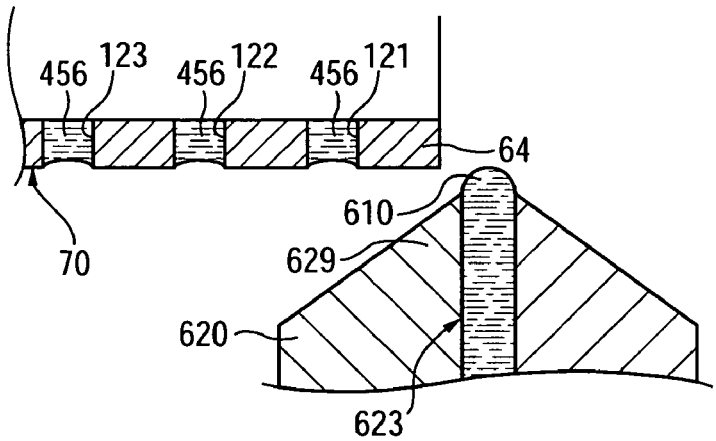

Then, as shown in FIG. 8C, the supply portion 620 of the liquid cleaning unit 600 moves along the nozzle surface 70 in the X1 direction to remove the whole discharging liquid 4 adhering to the nozzle surface 70, without coming into contact with the nozzle surface 70.

In this case, since a lyophobic treatment 70A is performed on the nozzle surface 70 shown in FIG. 6, the lyophobic treatment 70A can help the removal of the discharging liquid 4 from the nozzle surface 70. In this way, it is possible to reliably remove the discharging liquid 4 from the nozzle surface 70.

The liquid cleaning unit 600 and the transport unit 601 shown in FIG. 6 constitute a cleaning device 550 for the nozzle surface 70. The supply portion 620 of the liquid cleaning unit 600 of the cleaning device 550 relatively moves with respect to the nozzle surface 70 to bring the cleaning liquid 610 discharged in a strip shape from the slit 623 in the Z1 direction into contact with the discharging liquid 4, which is ink adhering to the nozzle surface 70. Molecular force between the cleaning liquid 610 and the discharging liquid 4 due to the contact causes the discharging liquid 4 on the nozzle surface 70 to be mixed with the cleaning liquid 610 from the slit 623. Then, when the supply portion 620 relatively moves in the X1 direction parallel to the nozzle surface 70, the discharging liquid 4, which is ink mixed with the cleaning liquid 610, is stuck to the slit 623 by surface tension, so that the discharging liquid 4 can be easily removed from the nozzle surface 70 to be collected to the supply portion 620.

In this case, it is preferable to use a solvent used for a drawing ink as the cleaning liquid 610 used for the above-mentioned operation of cleaning the discharging liquid 4 from the nozzle surface 70, which is called a non-contact wiping operation. As the solvent, any one of xylene, acetone, decane, butylcarbitol acetate (BCTAC), and ethanol can be used.

Of course, the same material as the ink discharged from the nozzle surface 70 can be used as the cleaning liquid 610.

As such, ink or a solvent (which is the main ingredient of ink) used for ink is used as the cleaning liquid 610, which makes it possible to prevent the nozzle surface and the head from being contaminated by other materials.

Figure 9:
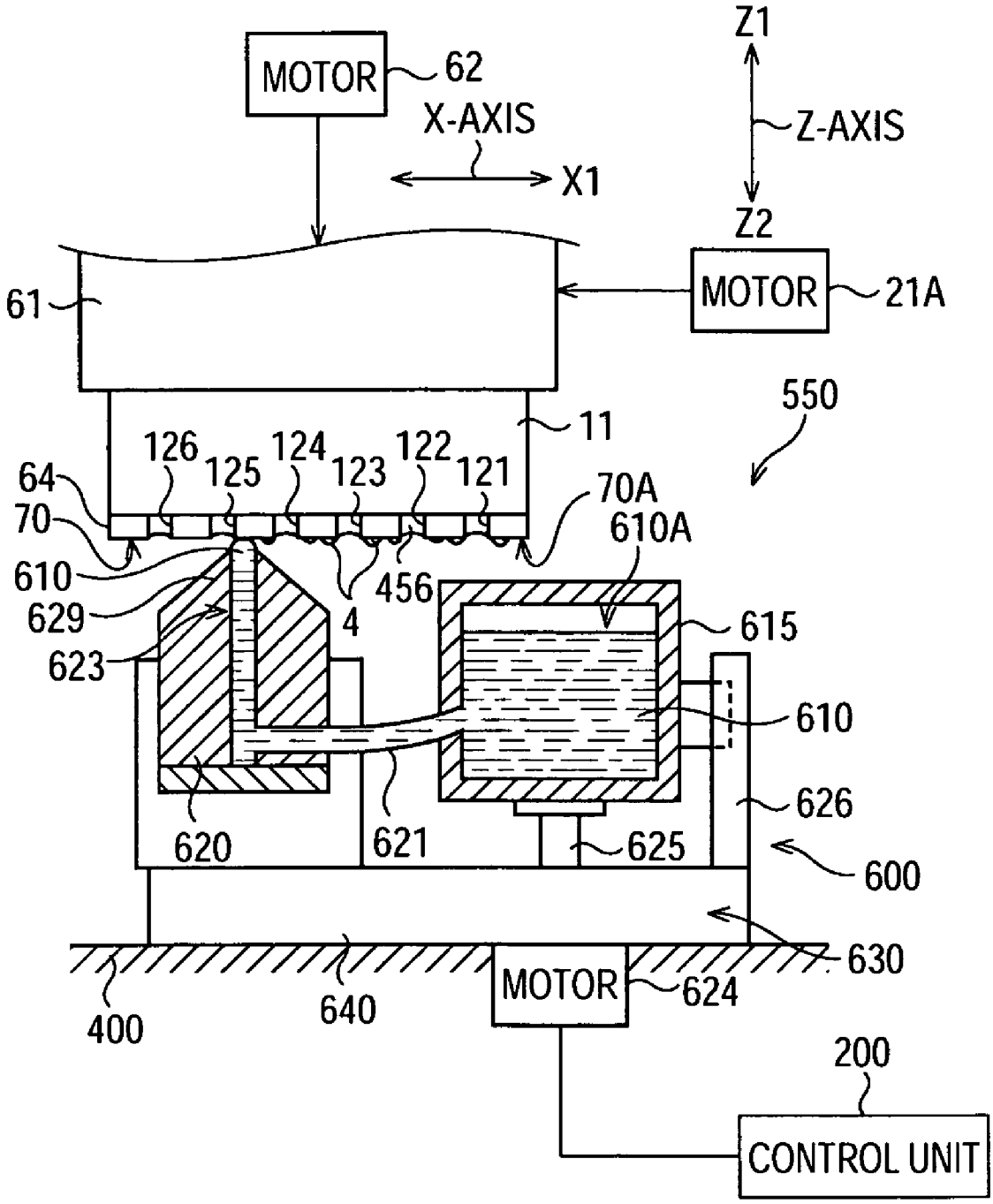
FIG. 9 is a view illustrating another embodiment of the invention.

FIG. 9 shows another embodiment of the invention.

A liquid cleaning unit 600 shown in FIG. 9 is different from the liquid cleaning unit 600 shown in FIG. 6 in that the liquid cleaning unit 600 of this embodiment is not provided with the transport unit 601 shown in FIG. 6, that is, the liquid cleaning unit 600 is fixed to the base 400.

The relative movement between the nozzle surface 70 and the liquid cleaning unit 600 is performed by using the motor 21A for the head 11 and the motor 62 shown in FIG. 2. The motor 21A can move the head 11 in the X-axis direction. The motor 62 can move the head 11 in the Z-axis direction.

In this way, since the head 11 is moved in the Z1 direction by the motor 62, the cleaning liquid 610 from the upper end 629 of the slit 623 of the supply portion 620 can be mixed with the discharging liquid 4 on the nozzle surface 70, as shown in FIG. 9.

Further, when the motor 21A moves the head 11 in the X1 direction of the X-axis, the upper end 629 of the slit 623 is moved parallel to the nozzle surface 70, so that the cleaning liquid 610 is mixed with the discharging liquid 4, which makes it possible to remove the discharging liquid 4 from the nozzle surface 70.

Furthermore, since the supporting member 640 and the liquid level changing portion 630 of the liquid cleaning unit 600 are the same components as those in FIG. 6, a description thereof will be omitted in this embodiment. In addition, the supply portion 620 and the storage portion 615 have the same structure as those in FIG. 6, and thus a description thereof will be omitted.

In this embodiment, the cleaning liquid of the liquid cleaning unit is mixed with the discharging liquid by the relative movement between the nozzle surface of the head and the liquid cleaning unit, which makes it possible to remove the discharging liquid from the nozzle surface. Therefore, the meniscus of the discharging liquid in the nozzle openings is not damaged unlike the related art, and the nozzle surface is not contaminated by the discharging liquid, which makes it possible to prevent a flying curve of liquid droplets when the liquid droplets are discharged. In addition, since the liquid droplets do not adhere to the nozzle surface, it is possible to reliably prevent the corrosion of the nozzle surface.

In this embodiment, since the supply portion moves substantially parallel to the nozzle surface, it is possible to reliably mix the cleaning liquid from the supply portion with the discharging liquid adhered to the nozzle surface.

In this embodiment, since a lyophobic treatment is performed on the nozzle surface, the cleaning liquid can be easily mixed with the discharging liquid, and thus the discharging liquid can be easily removed from the nozzle surface.

Further, in this embodiment, since the same solvent as that used for the discharging liquid to be supplied to the head is used, the nozzle surface of the head and the discharging liquid on the head are not contaminated by the cleaning liquid.

Furthermore, in this embodiment, since the same liquid as the discharging liquid to be supplied to the head is used as the cleaning liquid, it is possible to prevent the contamination of the nozzle surface and the discharging liquid to be discharged from the head.

Moreover, in this embodiment, the supply portion can reliably supply the cleaning liquid to the nozzle surface having the discharging liquid thereon, according to the residual amount of the cleaning liquid in the storage portion.

As described above, in this embodiment, it is possible to reliably prevent the meniscus of the ink in the head from being raked out from the nozzle surface when cleaning (wiping) the nozzle surface.

In this way, the discharging liquid does not adhere to the nozzle surface. Therefore, there is no fear that the remaining discharging liquid after cleaning will adhere around the nozzle openings, so that the flying curve of the liquid droplets discharged in the ink-jet method does not occur. As a result, defects in discharge can be prevented.

Further, this structure does not cause a phenomenon in which the discharging liquid adheres to the nozzle surface for a long time. Therefore, it is possible to reliably prevent the corrosion of the nozzle surface even in a case in which the liquid droplets are not discharged.

The embodiment of the liquid discharging apparatus according to the invention can be applied to a method of manufacturing an electro-optical device. The electro-optical device includes a liquid crystal display device, an organic EL (electro-luminescent) device, an electron emission device, a PDP (plasma display panel), and an electrophoresis device. In addition, the electron emission device includes a so-called FED (field emission display). Further, various devices required for forming, for example, metal wiring lines, lenses, a resist, and an optical diffuser are considered as the electro-optical device.

Figure 10:
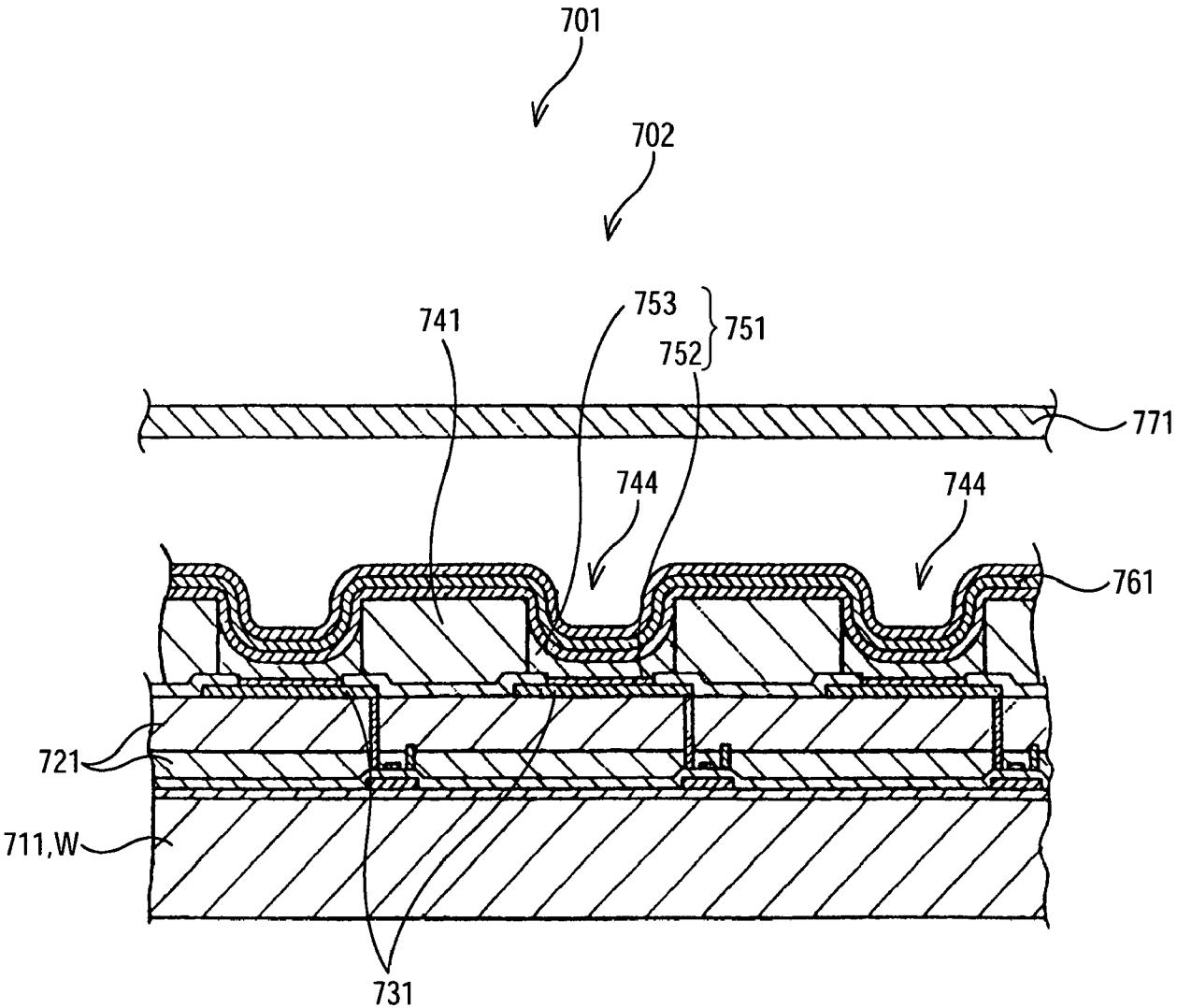
FIG. 10 is a cross-sectional view of an organic EL device that is manufactured by the liquid discharging apparatus of the invention.

FIG. 10 illustrates the structure of an organic EL device, which is an example of a flat panel display, when the organic EL device is manufactured using the liquid discharging apparatus according to the invention as a drawing apparatus. An organic EL device 701 is formed by connecting an organic EL element 702 composed of a substrate 711, a circuit element portion 721, pixel electrodes 731, a bank portion 741, light-emitting elements 751, a cathode 761 (counter electrode), and a sealing substrate 771 to wiring lines and a driving IC (not shown) on a flexible substrate (not shown).

The circuit element portion 721 is formed on the substrate 711 of the organic EL element 702, and a plurality of pixel electrodes 731 is arranged on the circuit element portion 721. The bank portion 741 is formed in a lattice shape between the pixel electrodes 731, and the light-emitting element 751 is provided in a concave portion 744 formed by the bank portion 741. The cathode 761 is formed on the entire surface of the bank portion 741 and the light-emitting elements 751, and the sealing substrate 771 is laminated on the cathode 761.

A method of manufacturing the organic EL element 702 includes a process of forming the bank portion 741, a plasma process of properly forming the light-emitting elements 751, a process of forming the light-emitting elements 751, a counter electrode forming process of forming the cathode 761, and a sealing process of forming the sealing substrate 771 on the cathode 761 to seal it.

That is, the organic EL element 702 is manufactured by the following procedure: the bank portion 741 is formed at predetermined positions on the substrate 711 (work W) having the circuit element portion 721 and the pixel electrodes 731 formed thereon; the plasma process, the process of forming the light-emitting elements 751, and the process of forming the cathode 761 (counter electrode) are sequentially performed; and the sealing substrate 771 is formed on the cathode 761 to seal it. In addition, since the organic EL element 702 is easily deteriorated by water in the air, it is preferable that the organic EL element 702 be manufactured in a dry air or inert gas (for example, argon or helium) atmosphere.

Further, each light-emitting element 751 includes a hole injecting/transporting layer 752 and a light-emitting layer 753 colored with any one of R (red), G (green), and B (blue), and the light-emitting element forming process includes a sub-process of forming the hole injecting/transporting layer 752 and a sub-process of forming the light-emitting layers 753 having three colors.

The organic EL device 701 is manufactured by, after forming the organic EL element 702, connecting wiring lines of the flexible substrate to the cathode 761 of the organic EL element 702, and by connecting wiring lines of the circuit element portion 721 to the driving IC.

Next, a case in which the liquid discharging apparatus 10 according to the invention is applied to manufacture a liquid crystal display device will be described.

Figure 11:
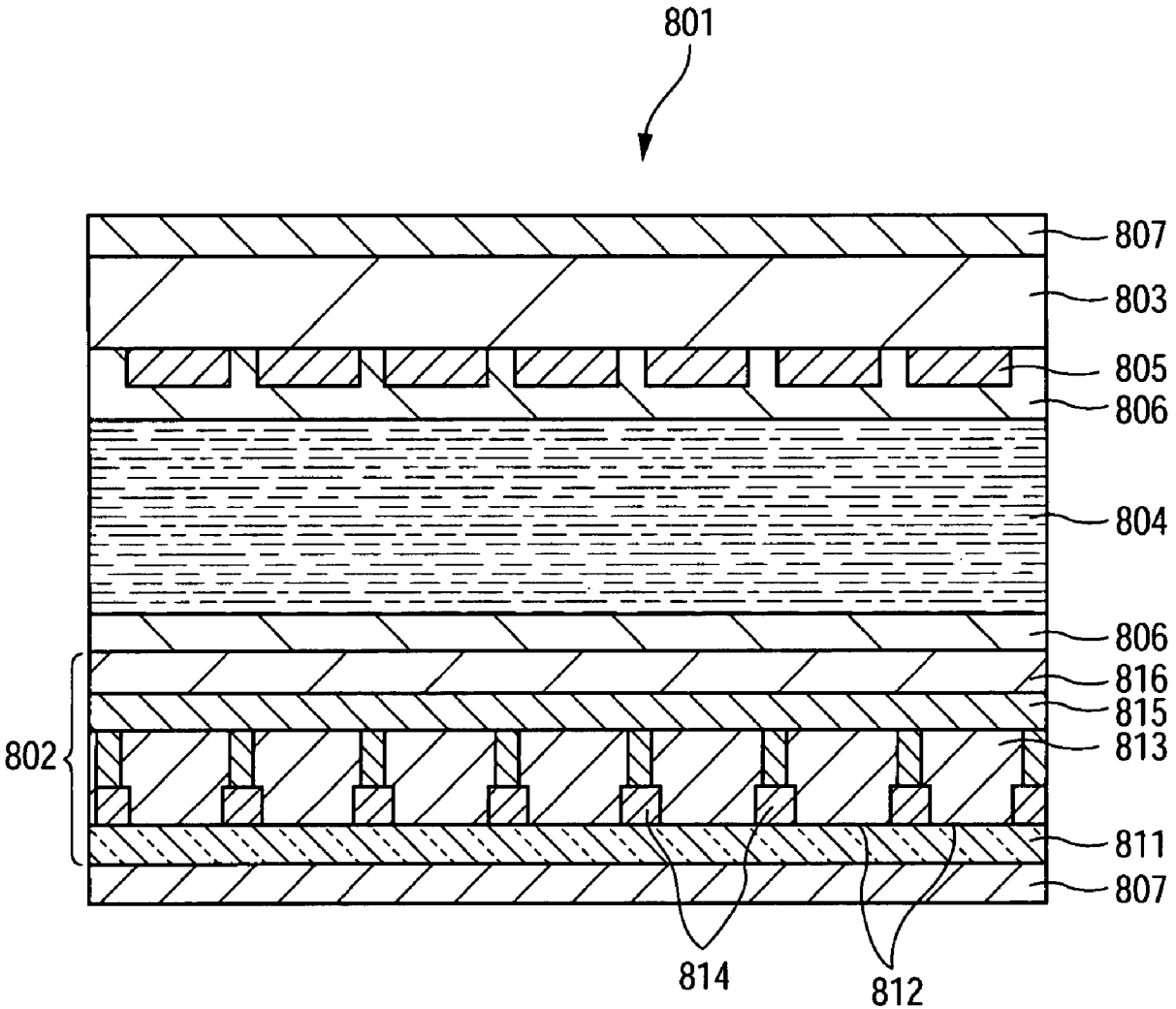
FIG. 11 is a cross-sectional view of a liquid crystal display device that is manufactured by the liquid discharging apparatus of the invention.

FIG. 11 shows the sectional structure of a liquid crystal display device 801. The liquid crystal display device 801 includes a color filter 802, a counter substrate 803, a liquid crystal composite 804 sealed between the color filter 802 and the counter substrate 803, and a backlight (not shown). Pixel electrodes 805 and TFT (thin film transistor) elements (not shown) are formed in a matrix on an inner surface of the counter substrate 803. Red, green, and blue colored layers 813 of the color filter 802 are arranged at positions opposite to the pixel electrodes 805. Alignment films 806 for aligning liquid crystal molecules in predetermined directions are formed on the inner surfaces of the color filter 802 and the counter substrate 803, respectively. In addition, polarizing plates 807 are bonded to outer surfaces of the color filter 802 and the counter substrate 803, respectively.

The color filter 802 includes a transparent substrate 811, a plurality of pixels (filter elements) 812 arranged in a matrix on the transparent substrate 811, a colored layer 813 formed on the pixels 812, and a light-shielding partition members 814 for partitioning the respective pixels 812. In addition, an overcoat layer 815 and an electrode layer 816 are sequentially formed on the colored layer 813 and the partition members 814.

Next, a method of manufacturing the liquid crystal display device 801 will be described below. In this method, first, the partition members 814 are formed on the transparent substrate 811, and then R (red), G (green), and B (blue) colored layers 813 are formed in the pixels 812, respectively. Subsequently, the overcoat layer 815 is formed with a transparent acrylic resin by a spin coating method, and the electrode layer 816 made of ITO (indium tin oxide) is formed, thereby forming the color filter 802.

The pixel electrodes 805 and the TFT elements are formed on the counter substrate 803. Subsequently, the alignment films 806 are formed on the color filter 802 and the counter substrate 803 having the pixel electrodes 805 thereon, respectively, and the color filter 802 and the counter substrate 803 are bonded to each other. Then, the liquid crystal composite 804 is injected between the color filter 802 and the counter substrate 803, and the polarizing plates 807 and the backlight are formed on the color filter 802 and the counter substrate 803, respectively.

The embodiment of the liquid discharging apparatus of the invention can be applied to form filter elements (R (red), G (green), and B (blue) colored layers 813) of the color filter. In addition, it can also be used to form the pixel electrodes 805 by using a liquid crystal material corresponding to the pixel electrodes 805.

Further, a device required for forming a preparation other than the metal wiring lines, the lenses, the resist, and the optical diffuser is considered as another electro-optical device. It is possible to effectively manufacture various electro-optical devices by using the liquid discharging apparatus to manufacture various electro-optical devices.

An electronic apparatus of the invention is equipped with the above-mentioned electro-optical device. In this case, the electronic apparatus includes a cellular phone, a personal computer, and various electric appliances which are provided with so-called flat panel displays.

Figure 12:
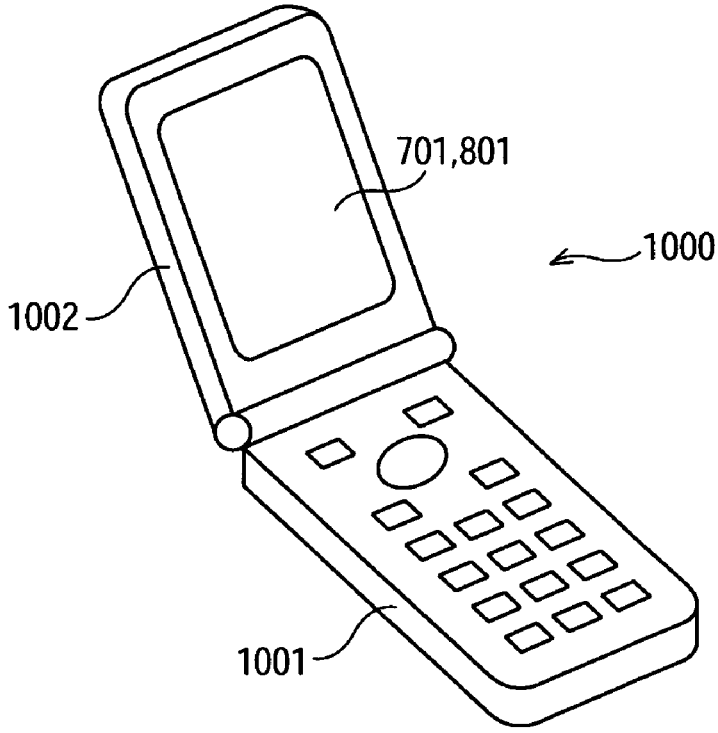
FIG. 12 is a perspective view illustrating a cellular phone, which is an example of an electronic apparatus including a display device manufactured by the embodiment of the invention.

FIG. 12 is a view illustrating the appearance of a cellular phone 1000, which is an example of the electronic apparatus. The cellular phone 1000 includes a main body 1001 and a display unit 1002. The organic EL device 701 or the liquid crystal display device 801, which is an example of the electro-optical device, is used as the display unit 1002.

Figure 13:
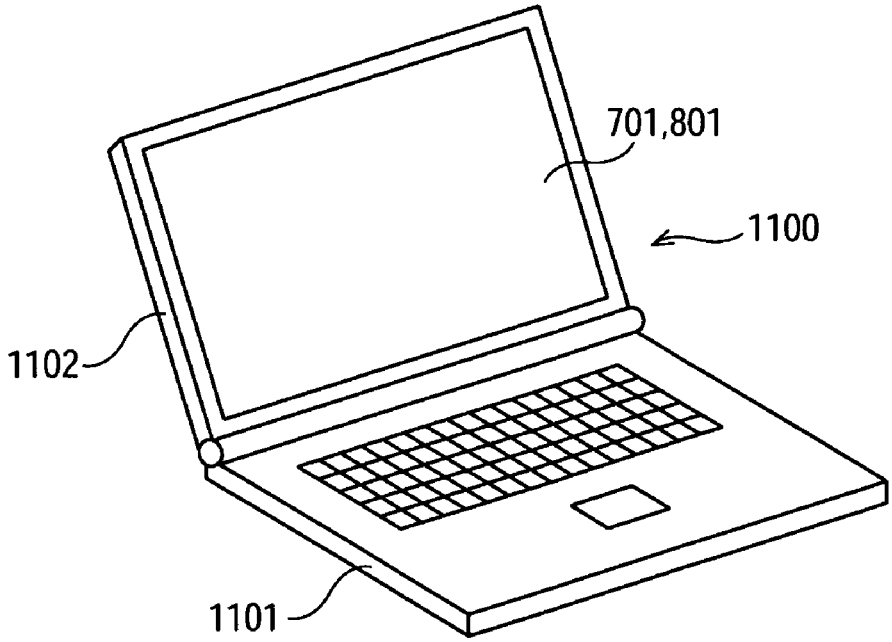
FIG. 13 is a perspective view illustrating a computer, which is another example of the electronic apparatus.

FIG. 13 shows a computer 1100, which is another example of the electronic apparatus. The computer 1100 includes a main body 1101 and a display unit 1102. The organic EL device 701 or the liquid crystal display device 801, which is an example of the electro-optical device, can be used as the display unit 1102.

The embodiment of the liquid discharging apparatus of the invention can also be used to perform black-and-white printing or color printing on a printing target, which is an example of a work. In this case, the liquid storage unit is an ink cartridge, and one kind or plural kinds of ink (for example, black, yellow, magenta, cyan, light cyan, light magenta, and the like) are separately stored in the ink cartridge. The ink is an example of liquid.

The liquid discharging apparatus of the above-mentioned embodiment is of a so-called off-carriage type in which a liquid pack, which is an ink pack, is arranged separately from the head 11. However, the invention is not limited to the off-carriage type, but may be applied to a liquid discharging apparatus of a so-called on-carriage type in which a liquid pack is mounted on the carriage having the head mounted thereon.

The liquid discharging apparatus of the invention has the following advantages, compared to the related art in which wiping is performed by using a wiping cross or a rubber wiper. In the method using the wiping cross, the ink in the nozzle openings may be drawn out by a capillary phenomenon. In addition, the method using the rubber wiper has problems, such as the abrasion of the wiper, the mixture of dust, and the abrasion of the nozzle plate.

On the contrary, according to the embodiments of the invention, it is possible to clean the nozzle surface of the head in a non-contact manner, only by mixing the cleaning liquid with the discharging liquid adhered to the nozzle surface to remove the discharging liquid. This structure hardly raises the above-mentioned problems of the related art.

The invention is not limited to the above-mentioned embodiments, and various modifications and changes of the invention can be made without departing from the scope and spirit of the invention as defined by the following claims. In addition, a combination of the above-mentioned embodiments may also be used.

What is claimed is:

1. A liquid discharging apparatus that discharges liquid droplets onto a work, comprising:

a head that is supplied with discharging liquid to discharge the liquid droplets;

a liquid cleaning unit that contains cleaning liquid to be mixed with the discharging liquid adhered to a nozzle surface of the head, said cleaning unit being separated from said head by a gap during cleaning of the head and including:

a storage portion that stores the cleaning liquid; and a supply portion that mixes the cleaning liquid of the storage portion with the discharging liquid adhered to the nozzle surface; and a transport unit that moves the nozzle surface of the head relative to the liquid cleaning unit to remove, from the nozzle surface, the discharging liquid adhered to the nozzle surface; wherein the supply portion is moved substantially parallel to the nozzle surface by the transport unit.

2. The liquid discharging apparatus according to claim 1, wherein a lyophobic treatment is performed on the nozzle surface to repel the discharging liquid.

3. The liquid discharging apparatus according to claim 1, wherein the discharging liquid is a solution containing a functional material, and the cleaning liquid is a solvent used for the solution.

4. The liquid discharging apparatus according to claim 1, wherein the same liquid as the discharging liquid to be supplied to the head is used as the cleaning liquid.

5. The liquid discharging apparatus according to claim 1, wherein the storage portion storing the cleaning liquid includes a liquid level changing portion that changes the liquid level of the cleaning liquid.

6. The liquid discharging apparatus according to claim 1, wherein the supply portion supplying the cleaning liquid includes a discharge height changing portion that changes the discharge height of the cleaning liquid.

7. The apparatus of claim 1, wherein the cleaning unit includes a nozzle and the cleaning fluid projects from the nozzle a distance greater than the gap to contact the nozzle surface of the head during cleaning of the head.

8. A liquid discharging apparatus that discharges liquid droplets onto a work, comprising:

a head that is supplied with discharging liquid to discharge the liquid droplets;

a liquid cleaning unit that contains cleaning liquid to be mixed with the discharging liquid adhered to a nozzle surface of the head, the liquid cleaning unit including:

a storage portion that stores the cleaning liquid; and a supply portion that mixes the cleaning liquid of the storage portion with the discharging liquid adhered to the nozzle surface, and a transport unit that moves the nozzle surface of the head relative to the liquid cleaning unit to remove, from the nozzle surface, the discharging liquid adhered to the nozzle surface; wherein the supply portion is moved substantially parallel to the nozzle surface by the transport unit; and wherein a lyophobic treatment is performed on the nozzle surface to repel the discharging liquid.

9. A liquid discharging apparatus that discharges liquid droplets onto a work, comprising:

a head that is supplied with discharging liquid to discharge the liquid droplets;

a liquid cleaning unit that contains cleaning liquid to be mixed with the discharging liquid adhered to a nozzle surface of the head; and a transport unit that moves the nozzle surface of the head relative to the liquid cleaning unit to remove, from the nozzle surface, the discharging liquid adhered to the nozzle surface;

wherein the liquid cleaning unit includes:

a storage portion that stores the cleaning liquid; and a supply portion that mixes the cleaning liquid of the storage portion with the discharging liquid adhered to the nozzle surface, the supply portion is moved substantially parallel to the nozzle surface by the transport unit; and the storage portion storing the cleaning liquid includes a liquid level changing portion that changes the liquid level of the cleaning liquid.

* * * * *